United States Patent [19]

Podvin et al.

[11] 4,003,525

[45] Jan. 18, 1977

[54] STRIP MATERIAL UNWINDING DEVICE

[75] Inventors: Richard T. Podvin, Fridley; Thomas F. Look, New Brighton, both of Minn.

[73] Assignee: Minnesota Mining and Manufacturing Company, St. Paul, Minn.

[22] Filed: July 14, 1975

[21] Appl. No.: 595,397

[52] U.S. Cl. ..... 242/55; 242/68.3; 242/75.5

[51] Int. Cl.[2] ..... B65H 17/02; B65H 23/20; B65H 75/02

[58] Field of Search ..... 242/75.5, 75.51, 75.43, 242/75.44, 68, 68.3, 72, 55.2, 46.6, 55, 68.1, 68.2

[56] References Cited

UNITED STATES PATENTS

| | | | |
|---|---|---|---|
| 2,430,639 | 11/1947 | Jacques | 242/75.51 X |
| 2,664,250 | 12/1953 | Friedman | 242/75.5 UX |
| 3,317,150 | 5/1967 | Summersby | 242/55.2 |
| 3,365,143 | 1/1968 | Espel | 242/75.51 |
| 3,495,784 | 2/1970 | Bradlee | 242/75.5 |
| 3,565,366 | 2/1971 | Campbell | 242/75.51 X |
| 3,892,368 | 7/1975 | Ricards | 242/55.2 |

*Primary Examiner*—Stanley N. Gilreath
*Assistant Examiner*—John M. Jillions
*Attorney, Agent, or Firm*—Alexander, Sell, Steldt & DeLaHunt

[57] ABSTRACT

A device adapted for supporting a high inertia spool of stretchable strip material which strip material is withdrawn from the spool at varying rates by a strip applicating machine. The device includes a member which guides a length of the strip material being withdrawn. The guide member is adapted to be pivoted by tension in the strip material being withdrawn, and when pivoted activates a variable speed motor which rotates the spool to unwind the strip and maintain tension in the strip below an acceptable value. The motor is coupled to the spool through a worm drive which brakes rotation of the spool when the motor is de-energized to restrict over-running of the spool after tension in the strip is decreased.

5 Claims, 4 Drawing Figures

STRIP MATERIAL UNWINDING DEVICE

BACKGROUND OF THE INVENTION

This invention relates to devices for controlling the rotation of spools from which strip material is being withdrawn.

Two U.S. Pat. Nos. 3,899,383 and 3,944,457 both of which patents are also assigned to the assignee of this application, describe machines for applying parallel strips of stretchable reflex-reflective material to casings for bicycle tires such that when the tire casing is subsequently vulcanized the reflective strips provide reflective sidewalls for the tire.

Prior to the present invention, the supply of strip material for these machines was wound on flanged reels with each wrap of the strip material wound directly over the preceding wrap. The reel was then mounted on a device on the machine which permitted the reel to rotate freely while the strip material was withdrawn by operation of the machine, and which had a friction brake for braking rotation of the reel to prevent overrunning of the reel and spilling of the strip material when strip material was no longer being withdrawn by the machine.

Such a reel held a rather short length of the strip material (i.e. about 330 feet), however, and thus required rather frequent changes during production runs.

Techniques have now been developed for level winding stretchable strip material on a core (e.g. in the manner thread is wound on a spool) so that each layer of strip material around the core consists of a plurality of adjacent wraps and each wrap crosses the wraps upon which it is wound. Such a spool can hold a much greater length of strip material (e.g. in the range of 4500 to 9000 feet) and thus requires much less frequent changing during production. The aforementioned devices for supporting reels are not suitable for use with such spools, however, because the level wound spools have so much inertia that tension in the strip material is not sufficient to start and maintain proper rotation of the spool without introducing excessive stretch into the strip material.

SUMMARY OF THE PRESENT INVENTION

The present invention provides a device which affords withdrawing stretchable strip material from high inertia reels at varying rates without introducing excessive stretch into the strip material. The device is adapted for supporting a high inertia spool of the strip material and include means for sensing the rate at which the strip material being withdrawn from the spool, and means for rotating the spool to unwind the strip material at a rate approximately the same as that at which it is being withdrawn and to thereby maintain tension in the strip below an acceptable level. The device also includes means adapted for braking rotation of the spool when the strip material is no longer being withdrawn to thereby prevent spilling the strip material from the spool.

The device includes a hub adapted to receive the spool in a fixed position relative thereto, and a variable speed motor coupled to the hub. Means adapted for sensing the rate at which the length of strip material is being withdrawn from the spool senses tension in the strip material being withdrawn from the spool and activates variable power supply means coupled to the motor in direct proportion thereto to cause the strip material to be unwound from the spool at a rate which will maintain that tension below an acceptable level. The device also includes means for braking rotation of the hub when the rate of withdrawal of the strip material is decreased.

BRIEF DESCRIPTION OF THE DRAWING

The present invention will be more completely described with reference to the accompanying drawing wherein like numbers refer to like parts in the several views, and wherein.

DESCRIPTION OF A PREFERRED EMBODIMENT

Figure 1:
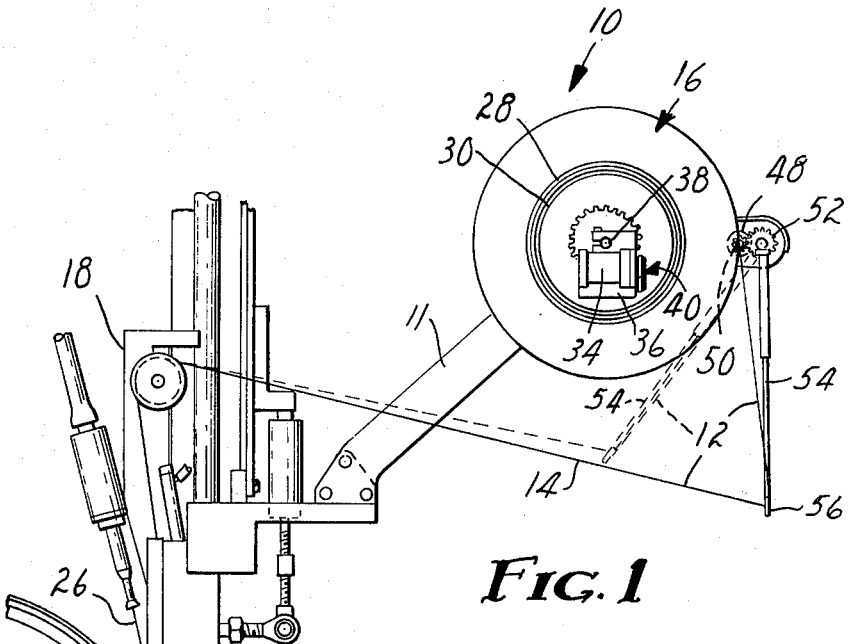
FIG. 1 is a vertical side view of a device according to the present invention shown mounted on a fragment of one embodiment of a machine for applying stretchable strip material to casings for bicycle tires.

Referring now to the drawing there are illustrated two devices 10 according to the present invention built on a common frame 11. Since the devices 10 are identical the following description will refer to each of the devices 10.

Each device 10 includes means responsive to tension in a length 12 of strip material 14 being withdrawn from a spool 16 of the strip material 14 for rotating the spool 16 to unwind the strip material 14 at a rate approximately the same as that at which it is being withdrawn by an applying machine 18, thereby maintaining the tension in the length 12 of strip material 14 below an acceptable level.

The applying machine 18 on which the devices 10 are mounted applies parallel lengths of the strip material 14 to a tire casing 20, and as illustrated in FIG. 1, is the applying machine described in U.S. patent application Ser. No. 501,609, the disclosure whereof is incorporated by reference herein.

Briefly the machine 18 includes a tire building wheel 22 on which there is tensioned the tire casing 20 to which the strip material 14 is to be applied. The machine 18 includes parallel heads 24 (only one of which is shown) each of which strips a liner 26 from a length of the strip material 14 fed thereto, presses the strip material 14 into engagement with the rotating casing to apply it thereto, and subsequently cuts off the applied length of strip material 14.

Figure 2:
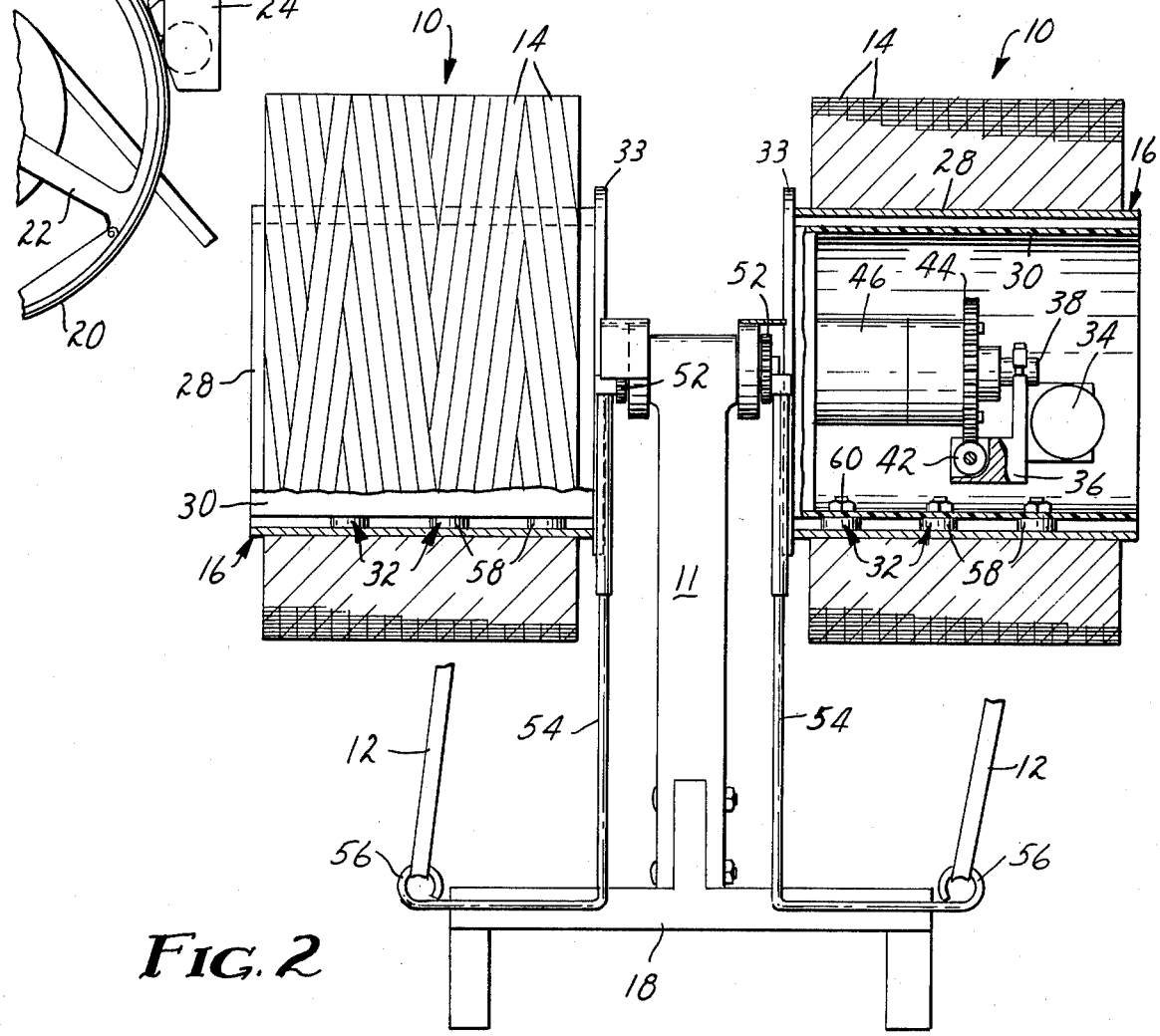
FIG. 2 is an enlarged fragmentary end view of the device illustrated in FIG. 1 which has portions thereof broken away to show details.
Figure 3:
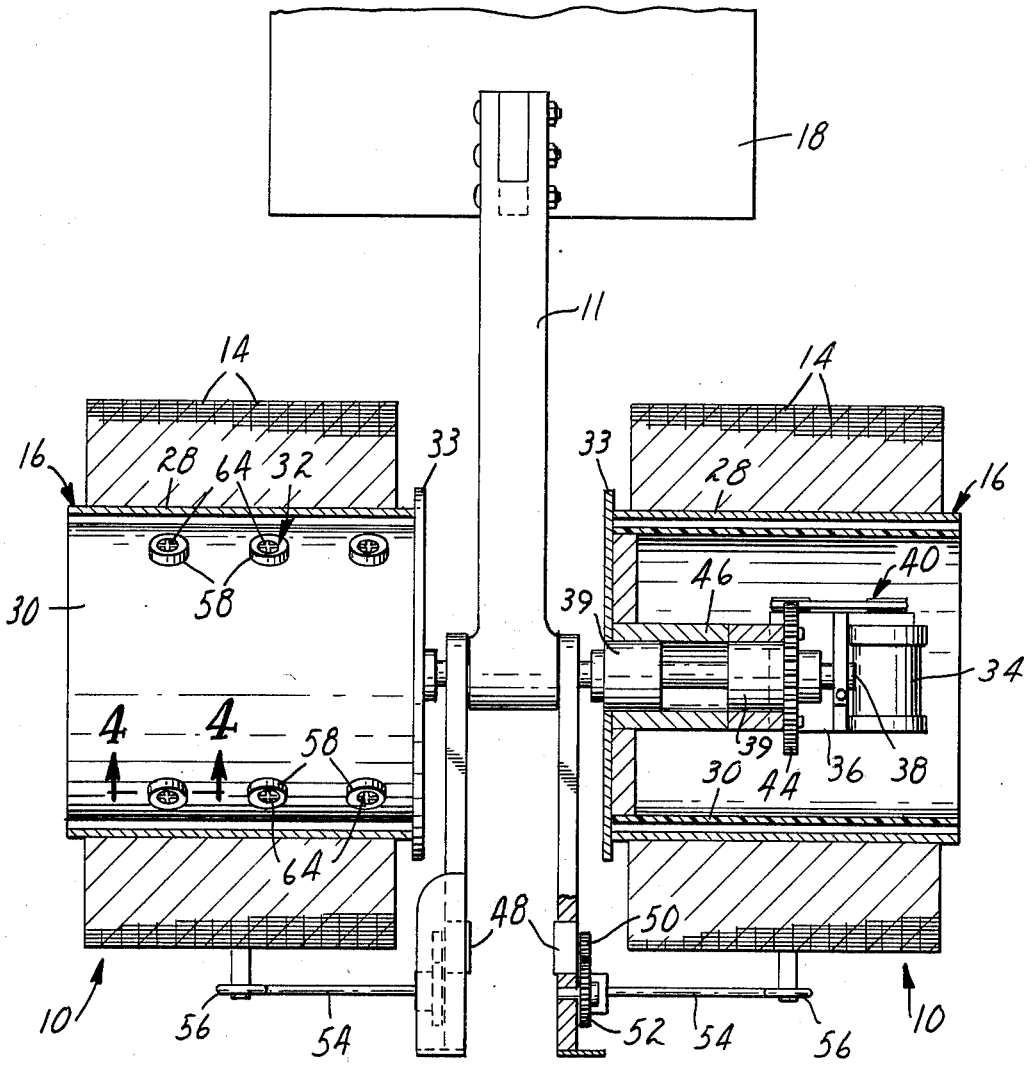
FIG. 3 is an enlarged fragmentary top view of the device illustrated in FIG. 1 which has portions thereof broken away to show details.

As is best seen in FIGS. 2 and 3, each spool 16 of strip material comprises a hollow cylindrical core 28 around which a length of the strip material 14 is level wound (i.e. wound in the manner that thread is normally wound about a spool). Each device 10 includes a hub 30 having a peripheral surface defined by a series of button-like protrusions 32. These button-like protrusions 32 (described in detail later herein) provide means for releasably and frictionally engaging an inner surface of the core 28 to cause rotation of the spool 16 with the hub 30. A flange 33 on each hub 30 locates the spool 16 axially of the hub 30.

The means in each device 10 responsive to tension in the length 12 of strip material 14 being withdrawn from the spool 16 on that device 10 for rotating the spool 16 includes a variable speed motor 34 mounted on a motor frame 36 fixed at an end of a shaft 38 fixed to the frame 11. The hub 30 is rotatably mounted on the shaft 38 via bearings 39 in a tube 46 which tube 46 forms a part of the hub 30. The hub 30 can be rotated by the motor 34 through an O-ring and pulley drive assembly 40 coupled to the motor 34 which drives a worm gear drive including a worm 42 mounted in the drive frame 36 and a gear 44 fixed at the end of the tube 46. Variable amounts of power are supplied to the motor 34 from a DC power supply (not shown) to control its speed via a potentiometer 48 mounted in the frame 11. The power applied to the motor 34 via the potentiometer 48 is adjusted by a rotatable central portion of the potentiometer 48 to which is coaxially fixed a spur gear 50. A drive gear 52 is rotatably mounted on the frame 11 and meshes with the spur gear 50. A rod-like member 54 has one end fixed to pivot with the drive gear, and has a loop 56 on its other end adapted to guide the length 12 of strip material 14 at a position between the spool 16 and the machine 18.

The weight of the guide member 54 provides means for biasing the second end of the guide member 54 to a first position below the drive gear 52 (see solid outline in FIG. 1). The potentiometer 48 and gears 50 and 52 are adapted to position the central portion of the potentiometer 48 at an off or no power position for the potentiometer 48 when the guide member 54 is in the first position. The loop 56 of the member 54 is thus positioned so that the portion of the length 12 of strip material 14 between the spool 16 and the loop 56 forms a sharp angle with respect to the portion of the length 12 of strip material 14 between the loop 56 and the machine 18. When operation of the machine 18 withdraws the strip material 14 from the spool 16 at an increased rate, increased tension in the length 12 of strip material 14 will tend to straighten this angle by rotating the guide member 54 upwardly and toward the machine 18 such as to the position shown in dotted outline in FIG. 1. Such rotation rotates the potentiometer 48 via the drive gear 52 and spur gear 50 toward a full power position to apply more power and start or increase the speed of the motor 34 to more rapidly unwind the strip material 14 from the spool 16 and thereby decrease the tension in the length 12 of strip material 14 between the spool 16 and machine 18. During withdrawal of the strip material 14 by the machine 18 the tension in the strip material 14 applied to the loop 56 equalizes with the gravitational force tending to return the support member 54 to its first position, and the length and weight of the support member 54 are adapted so that this tension does not exceed a predetermined level during the operational cycle of the machine 18.

The device 10 also includes means for braking rotation of the spool 16 when the strip material 14 is being withdrawn at a decreasing rate, or is not being withdrawn at all, to prevent spillage of the strip material 14 from the spool 16 by coasting of the spool 16. The friction in the motor 34 and drive assembly between the motor 34 and hub 30 amplified by the high mechanical advantage of the worm gear drive when torque is applied at the hub 30 provides this means for braking rotation of the spool 16.

Figure 4:
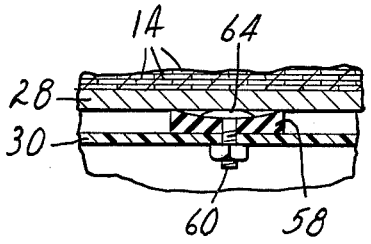
FIG. 4 is an enlarged fragmentary view taken approximately along lines 4—4 of FIG. 3.

The button-like protrusions 32 (best seen in FIGS. 3 and 4) which comprise the means for releasably and frictionally locking the core 28 to the hub 30 each include a resilient compressible thick washer 58 as of rubber attached to the hub 30 through its central opening by a bolt 60. An outwardly projecting head on the bolt has a generally convex peripheral surface 64 and has crossed slots recessed from the surface 64 which provide tooth-like projections along the surface 64. The bolt 60 is tightened to compress the center of the washer 58 while its outer edge projects about to the level of the surface 64. When the core 28 of the spool 16 is pressed over the button-like projections 32, edge portions of the washers 58 are compressed by the core 28 and frictionally hold the same. Also, the tooth-like projections of the bolt 60 cut into the core to further restrict rotation of the core 28 relative to the hub 30.

Such engagement by the projections is not required to securely lock the core 28 to the hub 30, however. Surprisingly the resilient washers allow relatively easy axial movement of the core 28 onto or off of the hub 30, while preventing rotation of the core 28 relative to the hub 30 as a result of forces encountered during operation of the device 10. Apparently the straight contour of the inner surface of the core 28 impinging against the exposed leading edges of the washers 58 when forces are applied to move the core 28 axially onto or off of the hub 30 allows such axial movement, while the concave curved surface impinging against the leading edges of the washers 58 when force is applied to rotate the core 28 relative to the hub 30 causes a substantial locking force to be established between the core 28 and washers 58. The curved surface on the hub 30 to which the washers 58 are bolted may also have a beneficial effect, however.

In the preferred embodiment which receives a 6 inch I.D. core 28 the washers 58 are of 50 to 55 durometer neoprene rubber, 0.14 inch thick and 0.75 inch in diameter, and are disposed in three axially aligned groups of three protrusions 32 each, the groups being spaced at 120° intervals about the hub 30.

While the preceding illustrates a preferred embodiment of the present invention, it will be appreciated that certain modifications can be made without departing from the spirit of the invention. For example, a gear reduced motor may be used as at least a portion of the drive for the hub. Thus the scope of the invention should not be limited to the embodiment disclosed, but only by the scope of the claims.

We claim:

1. A device adapted for supporting a high inertia spool of stretchable strip material being withdrawn at varying rates by a strip applicating machine said spool comprising a core having a central opening and a peripheral surface around which said strip material is wound, said device comprising:

a frame;

a hub mounted on said frame for rotation about an axis, said hub being adapted for coaxially receiving a said core with at least a portion of said hub in the central opening of said core;

means on said peripheral surface for releasably engaging the core of a said spool positioned on said hub to cause rotation of the spool with said hub, said means comprising a plurality of circumferentially and axially spaced radially projecting button-like projections, each of said projections comprising a resilient washer of frictional material and an attaching screw positioned generally centrally of said resilient washer adjusted to centrally compress said washer, the peripheral surface defined by said washers being adapted to frictionally receive the inner surface of a said core;

a variable speed motor mounted on said frame;

means for providing driving engagement between said motor and said hub;

power adjustment means adapted to be energized by an external conventional source of power and electrically coupled to said motor for adjusting the power supplied to said motor at power settings between no power and full power to vary the speed of rotation of said hub; and tension sensing means adapted for sensing the tension in a said length of strip material between a said roll of strip material and a said applicating machine and coupled to said power adjustment means for activating said power adjustment means in direct proportion to the tension in the strip material;

said means for providing driving engagement between said motor and said hub comprising means for braking inertial rotation of said hub upon a decrease in the amount of power supplied to said motor by said power adjustment means.

2. A device according to claim 1, wherein said power adjustment means comprise a control with a portion movable between an off and a full on position to correspondingly regulate power to said motor between no power and full power; and said tension sensing means comprises a guide member adapted to guide a said strip material between a said spool on said hub and a said applicating machine, coupled to the movable portion of said control, and positioned to move the movable portion toward said full on position upon increased tension in said strip material, and means for biasing said guide member to move the movable portion toward the off position.

3. A device according to claim 2, wherein said control is a potentiometer with said movable portion thereof being rotatable, said tension sensing means includes a gear pivotably mounted on said frame in engagement with said movable portion, said guide member is attached at one end to said gear and is pivotal therewith and has a second end opposite said movable portion having a loop adapted to receive the length of strip material between a said spool on said hub and a said applicating machine, said potentiometer and guide member being disposed so that said second end is lower when said movable member is in said off position than when said movable member is in said on position so that gravity provides said means for biasing said guide member to move the movable portion toward the off position, and being disposed so that increased tension in the length of strip material between a said spool on said hub and a said applicating machine tends to pivot said movable member to move said movable member toward said full on position.

4. A device according to claim 1, wherein said means for providing driving engagement between said motor and said hub includes a worm gear drive, the reverse resistance in said worm gear drive and the inertia of said motor providing said means for braking rotation of said drum upon a decrease in the amount of power supplied to said motor by said power adjustment means.

5. A device according to claim 4, wherein said hub is hollow and said motor and means for providing driving engagement between said motor and said hub are positioned within said hub.

* * * * *